United States Patent [19]

Dagard et al.

[11] Patent Number: 4,799,538

[45] Date of Patent: Jan. 24, 1989

[54] DEVICE FOR CONDENSING STEAM UNDER PRESSURE AND ITS APPLICATION TO THE COOLING OF A NUCLEAR REACTOR AFTER AN INCIDENT

[75] Inventors: Philippe Dagard, Marly le Roi; Michel Couturier, Le Vesinet, both of France

[73] Assignee: Framatome, Courbevoie, France

[21] Appl. No.: 880,975

[22] Filed: Jul. 1, 1986

[30] Foreign Application Priority Data

Jul. 1, 1985 [FR] France ..... 85 10022

[51] Int. Cl.[4] ..... F22B 1/02; F28B 1/02; G21C 9/00

[52] U.S. Cl. ..... 165/47; 165/13; 165/110; 165/911; 376/298; 376/299; 376/405; 122/34

[58] Field of Search ..... 165/108, 110, 47, 132, 165/32, 13, 911; 122/32, 34; 376/298, 299, 405

[56] References Cited

U.S. PATENT DOCUMENTS

| | | | |
|---|---|---|---|
| 448,542 | 3/1891 | Quiggin | 122/34 |
| 468,048 | 2/1892 | Rayner | 122/34 |
| 3,076,444 | 2/1963 | Bell | 122/34 |
| 3,190,808 | 6/1965 | Dodd | 165/911 |
| 3,503,373 | 3/1970 | Sokolowski | 122/32 |
| 3,921,591 | 11/1975 | Mayer et al. | 122/34 |
| 3,982,586 | 9/1976 | Ruble | 165/911 |
| 4,082,606 | 4/1978 | Houston et al. | 165/108 |
| 4,582,025 | 4/1986 | Grasso | 122/32 |
| 4,687,626 | 8/1987 | Tong | 376/298 |

FOREIGN PATENT DOCUMENTS

| | | | |
|---|---|---|---|
| 0956957 | 9/1982 | U.S.S.R. | 165/3 |
| 0454453 | 10/1936 | United Kingdom | 165/132 |
| 0890977 | 3/1962 | United Kingdom | 122/34 |

OTHER PUBLICATIONS

R. A. George and C.K. Paulson, "A Nuclear Plant Design for the 1990's Meeting Tomorrow's Needs;" presented at annual meeting of American Power Conference, Chicago, Apr. 1983.

*Primary Examiner*—Albert W. Davis, Jr.
*Assistant Examiner*—John K. Ford
*Attorney, Agent, or Firm*—Pollock, Vande Sande & Priddy

[57] ABSTRACT

Device for condensing steam under pressure consisting of a unit incorporating a storage vessel (6) containing cooling water, a distribution and heat exchange unit (15) fixed inside the storage vessel (6) and a water supply (30,31) for replacing the water in a storage tank (6) which is vaporized by contact with the tubes (24) of the distribution and heat exchange unit (15). A stack (7) is connected to the upper part of the storage vessel (6) and a tranquilizer grid is arranged in the storage vessel, above the heat exchange unit (15). The circulation of the fluid which is constituted of a two-phase mixture of water and steam is thus activated, while avoiding drawing out a significant quantity of water with the steam.

3 Claims, 2 Drawing Sheets

FIG.3
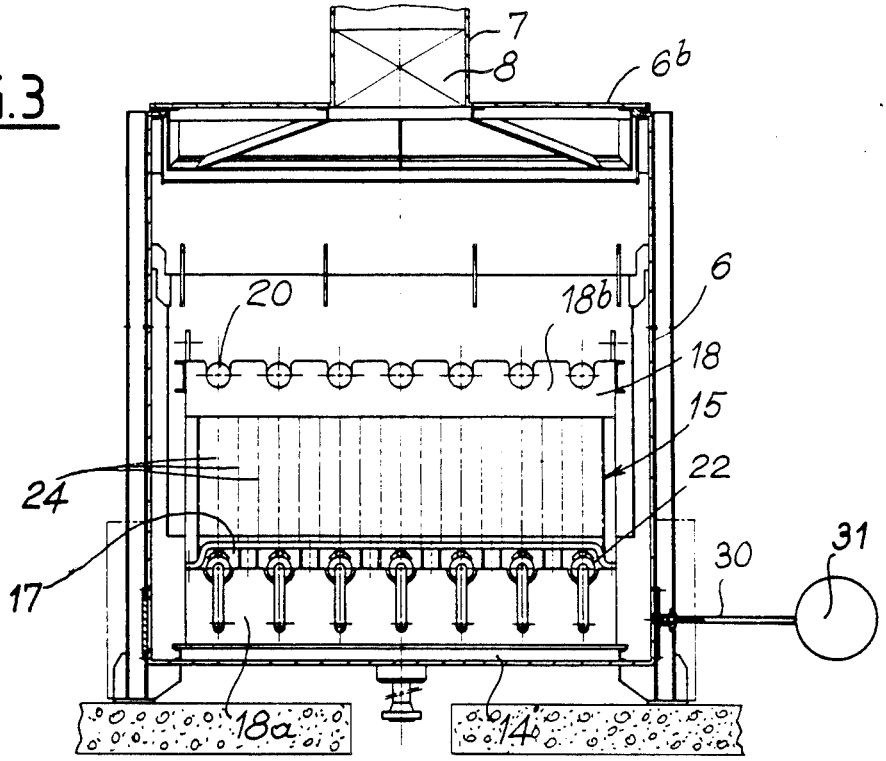
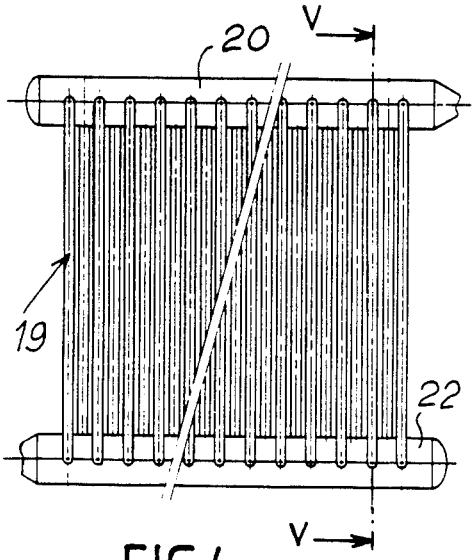
FIG.4
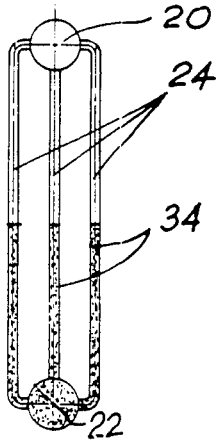
FIG.5

DEVICE FOR CONDENSING STEAM UNDER PRESSURE AND ITS APPLICATION TO THE COOLING OF A NUCLEAR REACTOR AFTER AN INCIDENT

FIELD OF THE INVENTION

The invention relates to a device for condensing steam, at a pressure substantially above atomospheric pressure, e.g., the steam produced by a steam generator of a pressurized-water nuclear reactor during its cooling after an accident.

BACKGROUND OF THE INVENTION

Devices permitting the cooling of a pressurized-water nuclear reactor after its shutdown following an accident are known. Such devices incorporate, in association with each of the loops of the primary circuit of the reactor, an auxiliary feed circuit for the corresponding steam generator. In this auxiliary circuit a condenser is arranged, connected to both the outlet of the steam generator and to the feed water inlet of this steam generator. When the auxiliary circuit is in operation, the condenser receives steam from the generator and ensures its condensation. The auxiliary circuit condenser may be positioned at a higher level than the settling level of the water present in the steam generator, so that the condensate may be redirected to the steam generator by gravity circulation.

While the reactor is being cooled, the steam leaving the generator is at a high temperature and pressure, both of which can vary during the cooling. This temperature and this pressure are 300° C. and $86.10^5$ Pa, respectively, at the beginning of the cooling and 160° C. and 5.8 $10^5$ Pa at the end of the cooling, just before the cooling circuit comes into operation when the reactor is shut down. Known condensers which are employed, for example, at the outlet of the turbine stages of electrical power stations are not suitable for cooling such steam at a high temperature and high pressure, with condensate recirculation, and other devices have been suggested, such as, for example, condensers immersed in a large volume of stored water. The condensers consist of a distribution and exchange unit incorporating a tube assembly in which the steam circulates. Cooling and condensation of this steam are carried out by virtue of the cooling of the tubes immersed in the stored water. This storage consists of one or more pools arranged in the structure of a building adjoining the reactor containment shell, at a height situated above the steam generators.

This arrangement considerably complicates the design of the nuclear power station buildings and, in the case of some types of power station, it is not even possible to envisage the installation of such pools at a height.

Furthermore, the exchanges between the wall of the tubes and the bulk of water in which these tubes are immersed do not always take place under favorable conditions, although localized boiling of the mass of water in contact with the tubes promotes such exchanges, by virtue of the circulation of the steam produced.

Finally, control of the operation of the condensers immersed in large-volume pools is difficult to implement.

Condensers are also known which are constituted of a water storage vessel in which is immersed a unit comprising generally vertical exchange tubes which are connected each at its upper end to a steam inlet manifold, and at its lower end to a condensate discharge manifold. The water of the storage vessel which can be evaporated is replaced in the vessel. Such a condenser is, however, of a low efficiency, the thermal exchange on the external surface of the tubes not being enhanced by intense circulation of the water of the tank.

SUMMARY OF THE INVENTION

The object of the invention is consequently to offer a device for condensing steam at a pressure, substantially above atmospheric pressure comprising a storage vessel containing water, a distribution and exchange unit fixed inside the storage vessel and incorporating a set of substantially vertical exchange tubes connected each at its upper end to a condensate discharge manifold, and a means for supplying water to the storage vessel, a device which has a very high output by virtue of efficient heat exchanges and which calls for only a restricted quantity of cooling water in the equipment itself.

To this end, the upper part of the storage vessel is connected to a steam discharge stack operating by natural draught, and a substantially horizontal tranquilizer grid is arranged in the storage vessel above the exchange unit, to prevent the entrainment of water by the steam to the stack, the device constituting a boiler-condenser operating in such a way that the fluid in contact with the outer surface of the tubes consists of a two-phase mixture of water and of the steam produced, from the water of the storage vessel, by the heat of condensation of the pressurized steam and by the heat of the condensate, the circulation of the two phase mixture being accelerated by density effect and by the draught of the stack.

BRIEF DESCRIPTION OF THE DRAWINGS

To enable the invention to be more clearly understood, a description will now be given, by way of example, with reference to the appended figures, of an embodiment of a condensing device according to the invention.

FIG. 3 is a cross-sectional and elevational view along line C—C of FIG. 1.

FIG. 4 is an elevation view of a unit member of the distribution and exchange unit of the condensing device.

FIG. 5 is a view in cross-section along line V—V of FIG. 4.

DESCRIPTION OF PREFERRED EMBODIMENT

Figure 1:
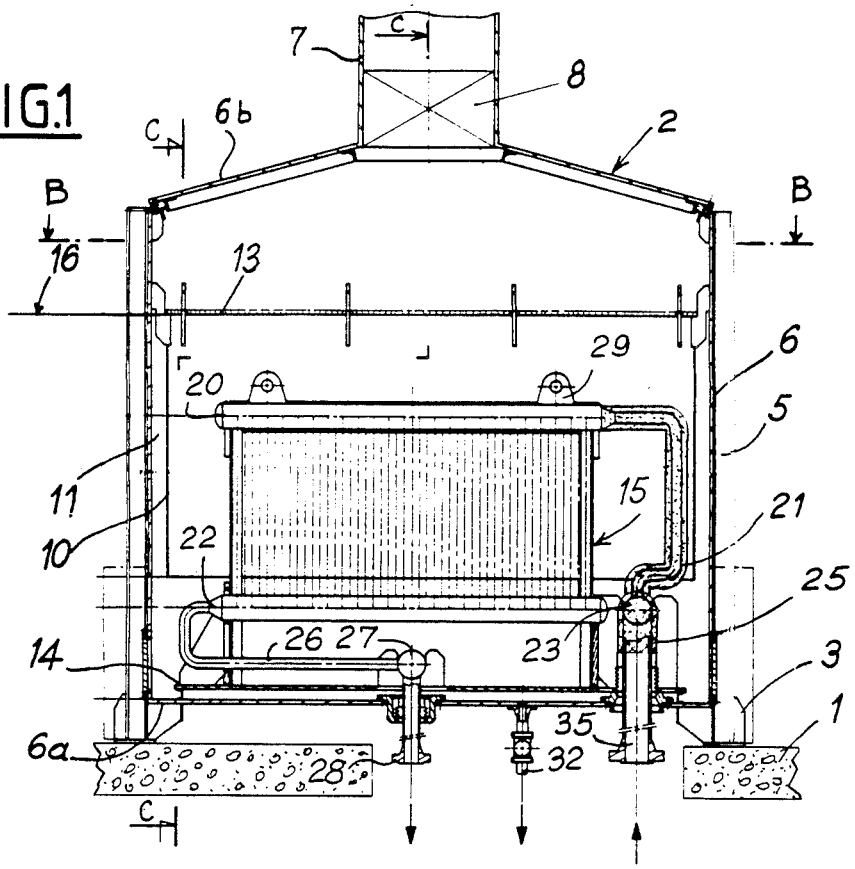
FIG. 1 is a vertical section view along line A—A of FIG. 2, of a condensing device according to the invention.

FIG. 1 shows a platform 1 which forms part of the structure of a power station building adjoining the reactor containment shell. The platform 1 is at a level which is higher than the steam generator.

The condensing device according to the invention, indicated generally by reference 2, rests on the platform 1 by means of supports 3 forming part of the robust structure of the device 2, this robust structure incorporating a set of beams placed vertically and fixed integrally to the outer wall of the storage vessel 6 which they provide with mechanical strength and rigidity. The storage vessel 6, of parallelipipedic shape, incorporates a bottom **6*a* made of thick metal sheet welded to the side walls which are stiffened by the beams 5, and a removable cover 6b resting on the top part of the storage tank and incorporating a steam discharge stack 7. Driers 8 are arranged in the stack 7 to prevent entrainment the of water droplets by the steam leaving the storage vessel 6. As can be seen in FIG. 3, the cover 6b** is of a construction incorporating stiffening members.

Figure 2:
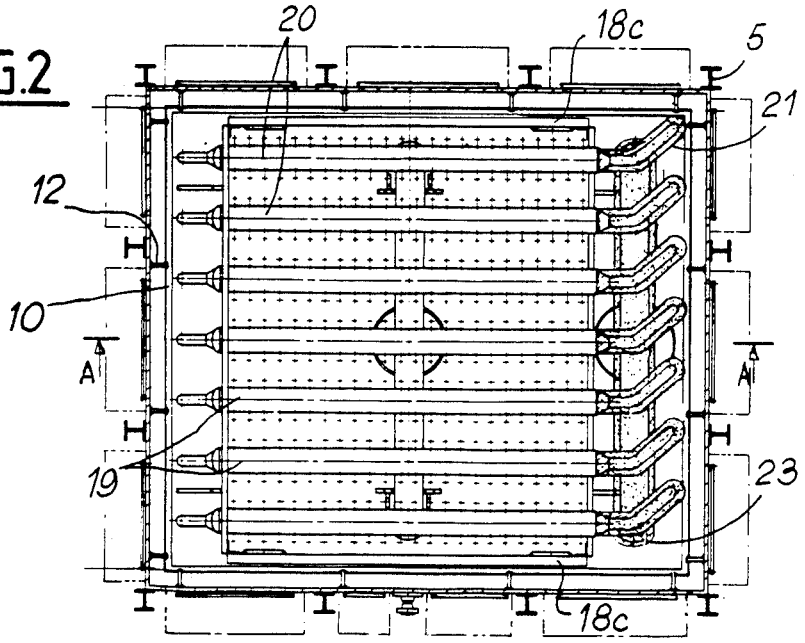
FIG. 2 is a plan view along line B—B of FIG. 1.

The internal structure of the storage vessel 6 can be seen in FIGS. 1, 2 and 3. This internal structure incorporates an inner wall 10 fixed to the inner surface of the storage tank 6 by means of spacers 12, a tranquilizer grid 13, substantially horizontal and resting on the spacers 12, and a supporting deck 14 resting on the bottom 6b and supporting the distribution and exchange unit 15, immersed in the storage vessel water the upper level of which 16 corresponds substantially to the plane of the tranqulizer grid 13.

Unit 15 rests on the deck 14 by means of the lower part 18a of a cradle 18 which also includes an upper part 18b and side uprights 18c responsible for the assembly of the parts 18a and 18b.

The distribution and exchange unit comprises seven identical members 19, arranged parallel to each other, inside the cradle 18.

As can be seen in FIGS. 4 and 5, each of the members 19 comprises an upper steam inlet manifold 20, a lower condensate discharge manifold 22 and a set of tubes 24 arranged in three parallel rows between the manifolds 20 and 22. The tubes 24 are substantially vertical and connected by their upper part to the steam manifold 20 and at their lower part to the condensate manifold 22.

The rectilinear manifolds 20 are arranged following one another, with their axes parallel, bearing on the top part 18b of the cradle 18. Similarly, the manifolds 22 are arranged with parallel axes, following one another, on the lower bearing part 18a of the cradle 18 and held on this cradle by collars 17.

Each of the steam manifolds 20 is connected to a lagged feed line 21, the lines 21 being connected at their other ends to a steam distribution line 23 placed horizontally at the lower part of the unit 15 and itself connected to a pipe 35 passing through the bottom 6a of the storage vessel 6 in a leakproof manner by virtue of a bellows seal 25 absorbing the differential expansions between the line 35 receiving the high pressure steam and the wall of the storage vessel 6.

Similarly, each of the manifolds 22 is connected to a condensate discharge line 26; the lines 26 are connected to a horizontal condensate manifold 27 arranged at the lower part of the unit 15 and connected to a condensate discharge pipe 28 passing through the bottom 6a of the storage vessel in a leakproof manner. The manifolds 23 and 27 are fixed to cradles resting on the support deck 14 inside the storage vessel 6.

The entire device 15 is fixed inside the storage vessel 6, with which is forms a modular unit. This unit can be positioned on a platform 1 of a building adjoining the reactor containment shell at a level higher than the settling level of the water present in the steam generators. The steam inlet and condensate outlet pipe 35 and 28, respectively, are then connected to a pipe receiving the steam leaving the steam generator and to a pipe feeding this steam generator, respectively.

In addition, the cradle 18 supporting the unit 15 is also integrally attached to handling lugs 29 which make it possible, by virtue of a lifting device, to lift and to separate this unit 15 from the storage vessel when the cover 6b and the grid 13 have been removed and the connections of the pipes 35 and 28 have been dismantled. The installation, repair and maintenance of the condensing device 2 can thus be carried out without any difficulty.

A cooling water feed line 30 opens into the lower part of the storage vessel 6, this line being connected to a circuit 31 or to any other means of supplying cooling water. This line 30 could also open into the storage vessel 6 at any other point situated at a level below the level of the tranquilizer grid 13.

In particular, this circuit 31 may be made in a wholly passive form, as described in applicants' copending U.S. patent application Ser. No. 880,261, also filed on July 1, 1986. Such a passive circuit incorporates a feed tank containing water which is under pressurized gas. An inlet valve for the gas above the feed water, which is under the control of the cooling water pressure in the storage vessel 6, enables make-up water to be supplied to this storage vessel to maintain a constant level, for example to maintain this level in its position 16, shown in FIG. 1.

A drain line 32 passes through the bottom 6a of the storage vessel 6, making it possible to empty the storage vessel completely or to carry out a chemical treatment of the water in this storage vessel, continuously or otherwise, the treated water being reinjected via the circuit 31 and the pipe 30. The circuit 31 may be replaced by a simple injection pump controlled by a detector of the water level in the storage vessel 6.

The operation of the device is as follows: after the emergency shutdown of the reactor following the accident, the vapor from the steam generator with which the condenser 2 is associated is directed into the pipe 35 by means of valves provided in the auxiliary feed circuit of the steam generator. The steam is distributed by the manifold 23 and the pipes 21 to the various manifolds 20 of the units 19. The lagging of the lines 21 with a metal insulant makes it possible to avoid condensation of steam before it enters the manifolds 20 and, as a result, to avoid an increase in the quantity of water entrained by steam towards the turbine when the reactor operates under power. The steam is then distributed into the tubes 24, where it is condensed by heat exchange through the tube walls. The condensate 34 runs down the tubes and collects in the lower parts of these tubes 24 and then in the manifolds 22, before being recycled into the feed circuit of the steam generator by the pipe 28. The water, held in the storage vessel 6 up to the level 16 and in which the tubes 24 are immersed, boils where it is in contact with the tube walls, the steam being entrained upwards and passing through the cooling water until it passes through the tranquilizer grid which makes it possible to restrict the entrainment of water by the steam and to return it to the bottom of the exchange unit 15 by downward circulation in the space 11 provided between the inner wall 10 and the side wall of the storage vessel 6. Water arriving at the lower part of the exchange unit 15 begins to form steam, which reduces the relative density of the fluid in contact with the outer wall of the tubes 24, this fluid consisting of a mixture of steam and water. This fluid consequently rises rapidly by density effect along the tubes ensuring their cooling and, ipso facto, condensation of the pressurized steam circulating in these tubes. A continuous upward circulation of the cooling fluid is thus produced along the tubes 24, with a return of the fluid relieved of its steam via the peripheral part of the storage vessel 6. The circulation and the renewal of the cooling fluid are all the more rapid because the quantity of water in the storage vessel 6 is relatively small relative to the volume of the heat exchange cooling unit 15, and very small relative to the volume of the cooling ponds of the condensing units according to the prior art. Steam produced in contact with the tubes 24 and separated from the fluid which circulates rapidly in the storage vessel is extracted from the storage vessel 6 by the grid 13 via the stack 7, the driers 8 enabling the droplets of water which are still present in the steam to be returned to the storage vessel 6. The natural draught of the stack 7 permits the circulation of the steam and thus the circulation of the two phase fluid along the exchange tubes 24 to be accelerated. The water discharged to the atmosphere in the form of steam via the stack 7 is replaced in the storage vessel 6 by the make-up water, by virtue of the water supply means 30. A relatively high rate of renewal of the water in the storage vessel 6 can be provided, which promotes a rapid circulation and intense cooling in contact with the tubes 24.

The device consequently operates as a boiler-condenser, the cooling water coming to the boil in contact with the thermal exchange surface. The cooling power of the exchange unit 15 can be regulated by controlling the rate at which the steam generator is fed with the condensate leaving this unit. Variations in this rate make it possible to vary the level of condensate 34 in the tubes 24. In practice, the cooling power of the exchange unit 15 is proportional to the empty length of the condensate tubes in which the condensation takes place. This empty length of the condensate tubes can be regulated by virtue of a means of controlling the rate at which the steam generator is fed with condensate. A passive control device based on this principle has been described in applicant's above-mentioned copending patent application, which relates to a device for cooling a nuclear reactor after an accident. It should be noted that the position of the interface separating the steam from the condensate 34 in the tubes 24 depends not only on the rate of flow of condensate in the steam generator feed circuit but also on the thermodynamic characteristics of the steam conveyed into the condenser 2.

The principal advantages of the device according to the invention are that is permits easier installation, by virtue of its reduced bulk and very high cooling and steam-condensing efficiency, by virtue of a rapid circulation of the cooling fluid in contact with the tubes obtained by passive means only. The feasilbility of the device is thus kept to a high level. In addition, thanks to the tranquilizer grid 13, only small quantities of water are drawn by the steam, in spite of an upwardly high-speed circulation of the steam. In addition, the device permits excellent control of the power which is shed, since the production of steam bubbles in contact with the tubes increases when the power introduced by the steam is increased and when, as a result, the relative density of the fluid in contact with the tubes diminishes. The relative density difference between this fluid and the water circulating downwards in the space 11 increases, increasing the driving force producing the circulation of the cooling fluid and consequently the rate of flow of this fluid.

The distribution and exchange unit may be constructed in a different form, with a number of exchange units and a number of rows of tubes in each of these exchange units which are different from those indicated in the above description. The tubes may be more or less inclined inside the storage vessel.

Similarly, the storage vessel may be of a different shape. The means of supplying water to this storage vessel for its replenishment may equally well be provided by a passive circuit or by a controlled system incorporating active units such as pumps.

Finally, the condensing device according to the invention may be employed not only in an auxiliary feed circuit of a steam generator forming a device for emergency cooling of a nuclear reactor, but also in any situation where it is necessary to condense steam at a pressure significantly above atomspheric pressure.

We claim:

1. Device for condensing steam at a pressure significantly above atmospheric pressure, comprising a storage vessel (6) containing water, a distribution and exchange unit (15) fixed inside the storage vessel (6) and incorporating a set of substantially vertical exchange tubes (24) each connected at its upper end to a steam inlet manifold (20) and at its lower end to a condensate discharge manifold (29), and a means (30, 31) for supplying water to the storage vessel (6), and for holding the water in the vessel (6) at a substantially fixed level (16) wherein (a) the upper part of the storage vessel (6) is connected to a steam discharge stack (7) operating by natural draught;

(b) a substantially horizontal tranquilizer grid (13) is arranged in the storage vessel (6), substantially at said fixed level, above the exchange unit (15) and under the discharge stack to prevent the entrainment of water by the steam to the stack (7);

(c) the device constituting a boiler-condenser operating in such a way that the fluid in contact with the outer surface of the tubes (24) consists of a two-phase mixture of water and of the steam produced by the heat of condensation of the pressurized steam and, by the heat of the condensate, from the water of the storage vessel (6), the circulation of the two-phase mixture being accelerated by density effect and by the draught of the stack (7).

2. Condensing device according to claim 1, wherein the storage vessel (6) incorporates an internal wall (10) over a part of its height, bounding a space (11) for the downward circulation of the cooling water and its return to the lower part of the exchange unit (15), between the wall (10) and the inner surface of the storage vessel (6).

3. Condensing device according to claim 1, wherein the stack (7) of the storage vessel (6) contains drying means (8) restricting the entrainment of water droplets by the steam leaving via the stack (7).

* * * * *